US011295571B2

(12) United States Patent
Plamondon

(10) Patent No.: US 11,295,571 B2
(45) Date of Patent: Apr. 5, 2022

(54) STACKING TOWELS AND DISPENSING APPARATUS

(71) Applicant: Malgorzata Plamondon, Bloomfield Hills, MI (US)

(72) Inventor: Malgorzata Plamondon, Bloomfield Hills, MI (US)

( * ) Notice: Subject to any disclaimer, the term of this patent is extended or adjusted under 35 U.S.C. 154(b) by 0 days.

(21) Appl. No.: 16/806,840

(22) Filed: Mar. 2, 2020

(65) Prior Publication Data

US 2020/0279448 A1 Sep. 3, 2020

Related U.S. Application Data

(60) Provisional application No. 62/974,277, filed on Nov. 22, 2019, provisional application No. 62/973,916, filed on Nov. 2, 2019, provisional application No. 62/973,393, filed on Oct. 2, 2019, provisional application No. 62/919,217, filed on Mar. 1, 2019.

(51) Int. Cl.
*G07F 9/10* (2006.01)
*G07F 11/04* (2006.01)

(52) U.S. Cl.
CPC ..... *G07F 11/045* (2013.01); *G07F 9/10* (2013.01)

(58) Field of Classification Search
None
See application file for complete search history.

(56) References Cited

U.S. PATENT DOCUMENTS

| | | | | |
|---|---|---|---|---|
| 1,506,463 | A | 8/1924 | Turnbull | |
| 5,894,927 | A * | 4/1999 | Bennett | B65D 83/005 206/438 |
| 5,972,456 | A * | 10/1999 | Esquivel | A47K 10/16 428/154 |
| 6,843,369 | B2 * | 1/2005 | Daniels | A47K 10/22 206/225 |
| D661,600 | S | 6/2012 | Hora et al. | |
| 9,808,131 | B2 | 11/2017 | Larsson et al. | |
| 10,364,090 | B2 | 7/2019 | DeMatteis et al. | |
| 2003/0075551 | A1 | 4/2003 | Dailey, III | |
| 2006/0266874 | A1 * | 11/2006 | Chou | A47K 10/3836 242/597.7 |
| 2009/0194553 | A1 | 8/2009 | Hoefing et al. | |
| 2011/0192862 | A1 * | 8/2011 | Knudsen | A47K 10/3818 221/46 |
| 2016/0176618 | A1 | 6/2016 | Baldridge et al. | |
| 2017/0325640 | A1 | 11/2017 | Trokhan et al. | |

FOREIGN PATENT DOCUMENTS

| | | |
|---|---|---|
| FR | 497139 | 11/1919 |

OTHER PUBLICATIONS

International Search Report for International Application PCT/US2020/020682, dated May 27, 2020.

* cited by examiner

*Primary Examiner* — Gene O Crawford
*Assistant Examiner* — Ayodeji T Ojofeitimi
(74) *Attorney, Agent, or Firm* — Burris Law, PLLC

(57) ABSTRACT

A towel set includes a towel holder and a plurality of towels stacked on one another. Each towel includes an opening, and the towel holder projects through the openings of the towels.

20 Claims, 12 Drawing Sheets

STACKING TOWELS AND DISPENSING APPARATUS

CROSS-REFERENCE TO RELATED APPLICATIONS

This application claims priority to and the benefit of U.S. Provisional Application No. 62/919,217, filed on Mar. 1, 2019; U.S. Provisional Application No. 62/973,393, filed on Oct. 2, 2019; U.S. Provisional Application No. 62/973,916, filed on Nov. 2, 2019; and U.S. Provisional Application No. 62/974,277, filed on Nov. 22, 2019. The disclosures of the above applications are incorporated herein by reference.

FIELD

The present disclosure relates to towels, such as those used in cleaning similar to washcloths, and more particularly to the design of such towels and apparatuses for holding and/or dispensing such towels.

BACKGROUND

The statements in this section merely provide background information related to the present disclosure and may not constitute prior art.

One-time use towels (such as paper or other disposable towels) have been widely used since being introduced to the market. The "use-and-toss" convenience and sanitary value of such towels have been a drive of their popularity and ubiquity in households throughout the world. The appeal further lies in having easy access to a desired quantity of fresh clean towels that are easily accessible. And, after use, such disposable towels are simply disposed of. However, one-time use towels are not environmentally friendly and can add significant costs over time for consumers.

Multiple-use towels (such as cloth towels or other paperless towels) are available and may be washed in between uses. After laundering, such multiple-use towels are typically folded and stored, such as in a kitchen drawer, which can take up valuable space. While these multiple-use towels are more environmentally friendly, their drawbacks include provisions for additional storage, folding, and laundering.

These issues related to the cost, environmental impact, disposal, storage, and organization of towels are addressed by the present disclosure.

SUMMARY

This section provides a general summary of the disclosure and is not a comprehensive disclosure of its full scope or all of its features.

In a form, a towel set includes a towel holder and a plurality of towels stacked on one another. Each towel comprises an opening, and the towel holder projects through the openings of the towels.

In a variation, the plurality of towels includes a plurality of double-layered towels.

In another variation, the plurality of towels includes a plurality of single-layered towels.

In yet another variation, a shroud extends around at least a portion of the plurality of stacked towels.

In a further variation, the towel holder is hinged.

In a yet further variation, the towel holder is height adjustable.

In a still further variation, the towel holder comprises a suctioning device.

In another form, a towel set includes a plurality of stacked towels. Each towel has an opening, and the openings are configured to receive an elongated member.

In a variation, the openings are axially aligned.

In another variation, the openings define a geometry selected from the group consisting of round, slit, and buttonhole. In a further another variation, the openings are located at a central portion of the towel. In a still further another variation, the openings are located at a position off-center of the central portion.

In yet another variation, the towels define a geometry selected from the group consisting of round, square, and polygonal.

In a further variation, the shroud extends around at least a portion of the plurality of towels.

In a yet further variation, the towel holder includes a base and the elongated member is secured to the base. The plurality of stacked towels rest on the base.

In a still further variation, a shroud is in sealing contact with the base for retaining used towels.

In yet another form, a towel holder includes a base and an elongated member secured to the base. A plurality of towels are stacked on one another, with each towel comprising an opening. The elongated member projects through the openings of the towels.

In a variation, a shroud extends around at least a portion of the towel set.

In another variation, the elongated member is curvilinear.

In yet another variation, the width of the elongated member is adapted to the openings of the towels.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
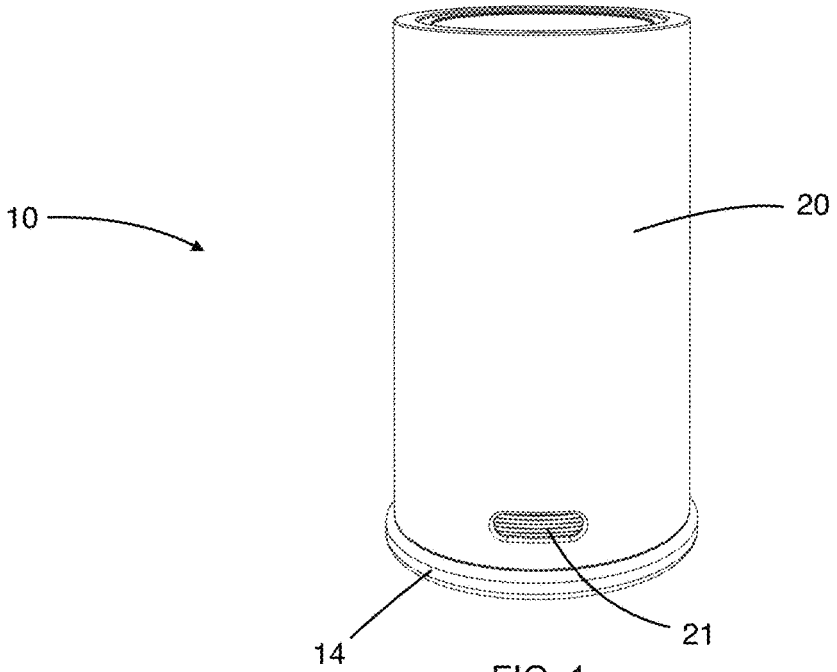
FIG. 1 is a perspective view of towel set with a shroud according to an aspect of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2A:
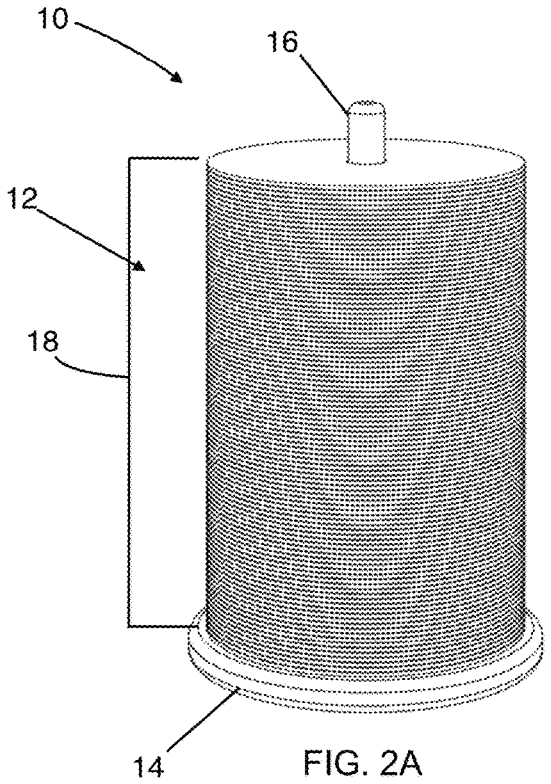
FIG. 2A is a perspective view of the arrangement of the towel set according to FIG. 1 without the shroud.
Figure 2B:
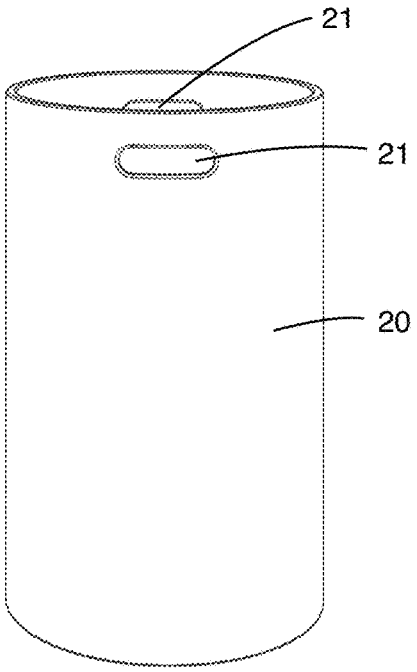
FIG. 2B is a perspective view of the shroud according to FIG. 1.

Referring to FIGS. 1, 2A, and 2B, the present disclosure includes a towel set 10 including a towel holder 12 (also shown in FIGS. 8A-8D) having an optional base 14 and an elongated member 16. The towel set 10 includes a plurality of towels 18. Optionally, the towel set 10 includes a shroud 20, which can function as both a cover for packaging and/or covering the towel holder 12 and the plurality of towels 18, as well as a receptacle (e.g., bucket) for receiving individual members of the plurality of towels 18 after use so that the plurality of towels 18 can be easily stored prior to laundering. Optionally, the shroud 20 includes at least an aperture 21, which can function as a handle for separating the shroud 20 from the towel holder 12 or as an indicator to visually determine if the towels 18 in the stack are few. While the shroud 20 is shown as a cylinder, the shroud 20 can have any geometrical shape that is configured to fit over the towel holder 12 and the plurality of towels 18, including, but not limited to shaped as a square, oval, hexagon, and other polygonal shapes, among others. The present disclosure also contemplates that the top of the shroud 20 could be the same or a different shape than the body of the shroud 20 and/or that the body of the shroud 20 need not have a congruous shape throughout the body of the shroud 20. The shroud 20 may be made of a variety of different materials, including but not limited to plastics, recycled plastics, aluminum or other metals, wood, glass, ceramic, composites, or other suitable materials. Alternatively, or in addition to the shroud 20, the plurality of towels 18 could be disposed in a mesh laundry bag for storage and/or laundering.

Figure 3:
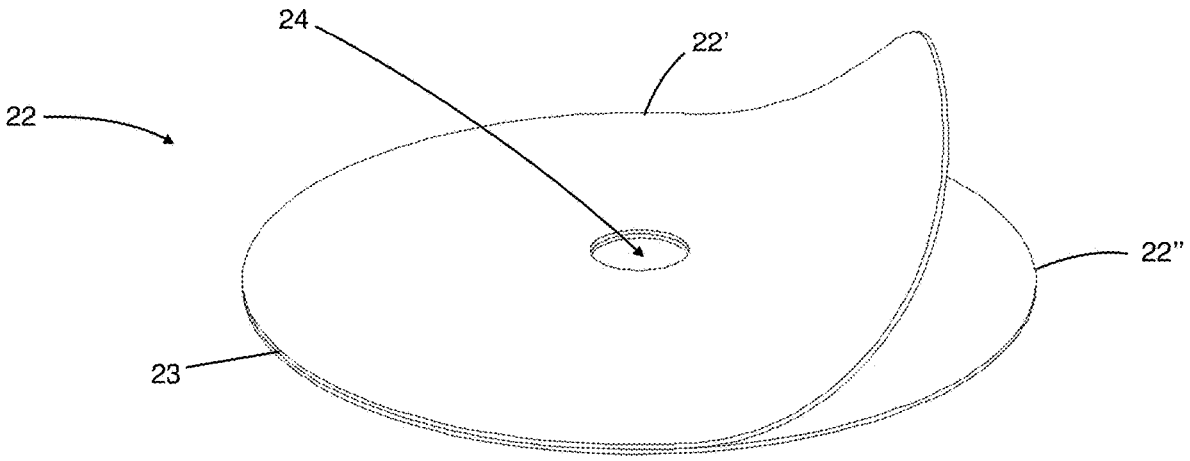
FIG. 3 is a perspective view of a towel for use in the towel set according to FIG. 2A according to an aspect of the present disclosure.
Figure 4:
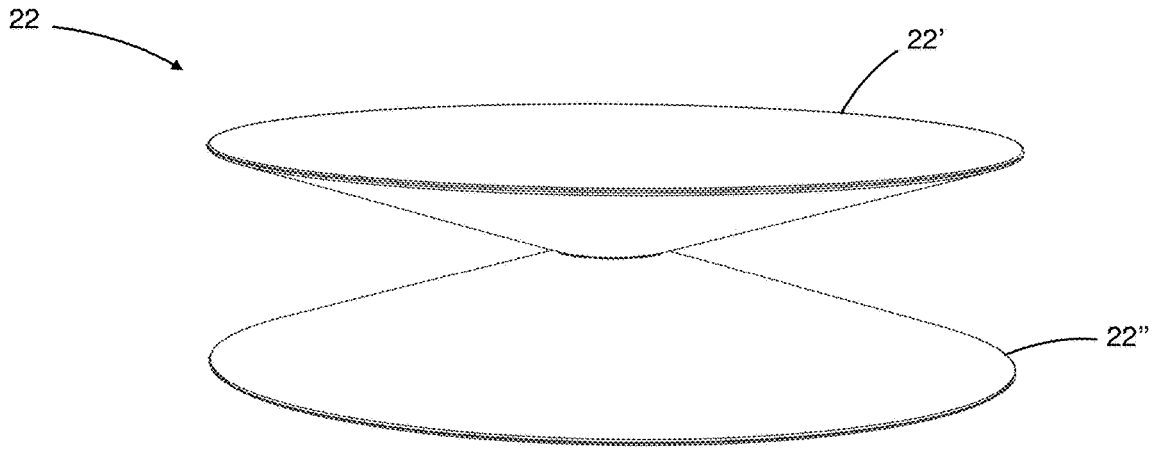
FIG. 4 is a perspective view of a towel for use in the towel set according to FIG. 2A according to another aspect of the present disclosure.
Figure 5:
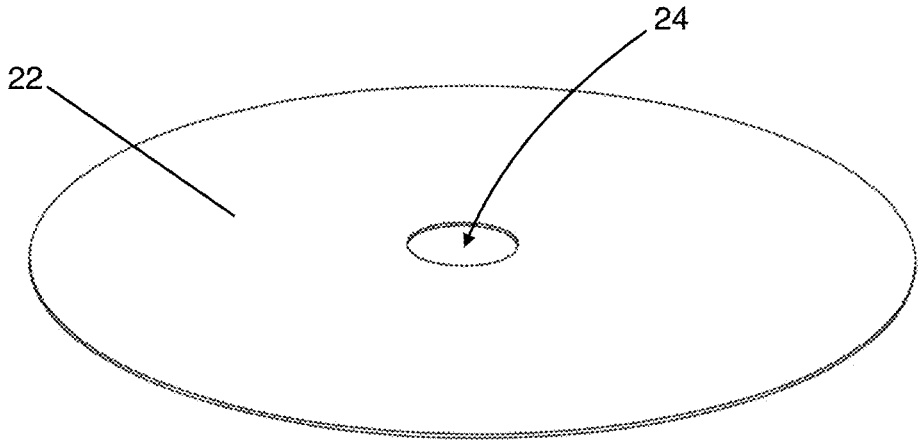
FIG. 5 is a perspective view of a single-layer towel for use in the towel set according to FIG. 2A according to yet another aspect of the present disclosure.

Turning now to FIGS. 3 through 6, an exemplary towel 22 for use in the towel set 10 is illustrated. As shown in FIG. 3, the towel 22 can comprise two individual towels 22', 22" that are connected with one another along at least an outer edge 23 to provide double absorbency and to enhance the multi-purpose capabilities contemplated under the present disclosure. Alternatively, or in addition, the towels 22', 22" can be interwoven with one another throughout their respective surfaces, or the towels 22', 22" can be interwoven with one another at desired locations. Similarly, as shown in FIG. 4, the towel 22 can comprise two towels 22', 22" that are connected with one another at an opening (such as the opening 24 shown in FIG. 3). In some forms, it is contemplated that the opening of one of the towels (e.g., towel 22') is threaded through the opening of the other towel (e.g., towel 22") to hide a stitch connecting the towels 22', 22" and further reinforce the connection between the towels. It is further contemplated that where multiple towels 22', 22" are connected to form a towel 22, a smaller surface area of the towel 22 may be used than where a single towel, such as towel shown in FIG. 5, is used. In other words, in configurations where the towel 22 comprises multiple towels 22', 22", smaller-sized towels, or towels of a variety of sizes, may be used than where the towel 22 is formed of a single towel. In this form, because the towels 22', 22" are connected at a minimum area, (e.g., connecting the towels 22', 22" at the opening 24) the towel 22 is lightweight and allows opening of the towel 22 for better agitation and extraction of soiling particles while washing the towel 22 and quicker drying of the towel 22. While FIGS. 3 and 4 show two towels connected with one another, the scope of the present disclosure extends to additional towels (e.g., 3, 4, or more) connected with one another. Where a connection between multiple towels are contemplated, the towels may be joined together by various means, such as sewing, gluing, bonding, or other methods for connecting the towels. It is also contemplated that one towel, such as towel 22', could comprise a different or the same surface than another towel, such as towel 22", which are then connected together. This could include using multiple or the same fabrics, fabric surfaces, or textures, which may increase the versatility of the towel 22. By way of not limiting example, a first towel could comprise any of a terry fabric, a waffle fabric, an exfoliating surface, an abrasive surface, or the like, whereas a second towel could comprise any of a terry fabric, a waffle fabric, an exfoliating surface, an abrasive surface, or the like. With such combinations, a desired effect can be attained which may enhance the multipurpose functionality of the towel set 10.

Referring to FIG. 5, in another form, a single towel 22 comprising a single towel (e.g., the towel 22') may be used.

Like with the examples shown in FIGS. 3 and 4, above, one surface of the towel 22 may be the same or differ from the other surface of the towel 22. This could include using multiple or the same fabrics, fabric surfaces, or textures, which may increase the versatility of the towel 22. By way of not limiting example, a first surface of the towel 22 could comprise any of a terry fabric, a waffle fabric, an exfoliating surface, an abrasive surface, or the like, whereas a second surface of the towel could comprise any of a terry fabric, a waffle fabric, an exfoliating surface, an abrasive surface, or the like.

The towel 22 may accordingly be a piece of material of any texture, any pattern, any shape, any size, and may be created by processes including die cutting, laser cutting, punching, folding or sewing multiple pieces of fabric together, or the like. Any desired opening 24 can be formed by similar means. The towel 22 can be reinforced by seaming, stitching, or otherwise reinforcing the fabric to improve functionality, durability, and aesthetic appeal as warranted. Any desired opening 24 can be reinforced by similar methods. Depending on the application, the towel 22 may be made of different materials, including but not limited to organic bamboo, recycled fabric, flannel, microfiber, exfoliating scrub cloth, paper, or any other suitable or otherwise desirable material.

The towel 22, while shown as a circle (e.g., in FIGS. 7A-7D), may take on any desired shape. By way of not limiting example, FIGS. 7E-7H illustrate the towel as squares. But other shapes are also contemplated hereunder, such as triangles, rectangles, hexagons, ovals, etc.

Figure 6:
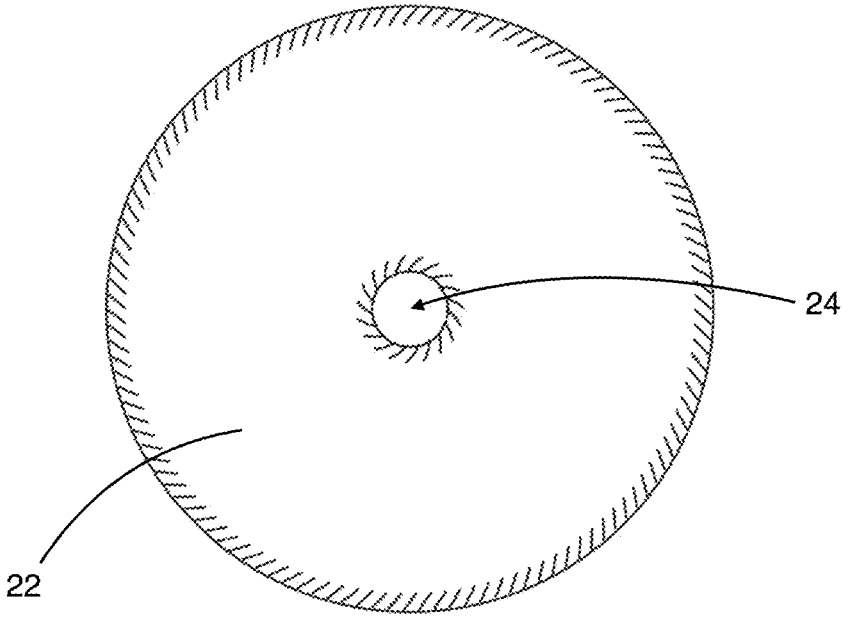
FIG. 6 is a top view of a towel for use in the towel set according to FIG. 2A.
Figure 7A:
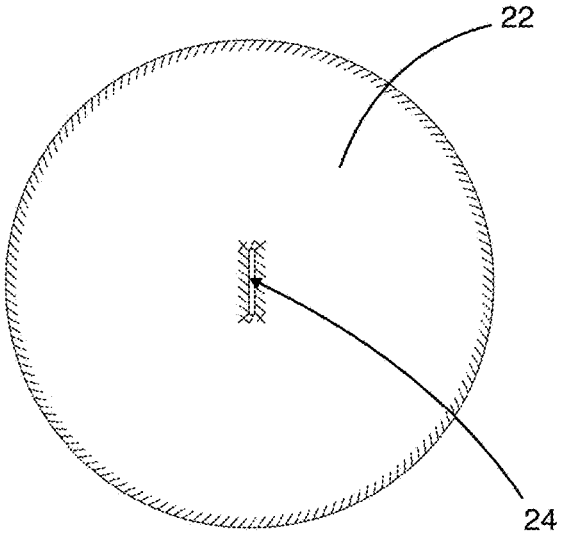
FIG. 7A is a top view of an exemplary towel according to the present disclosure.
Figure 7B:
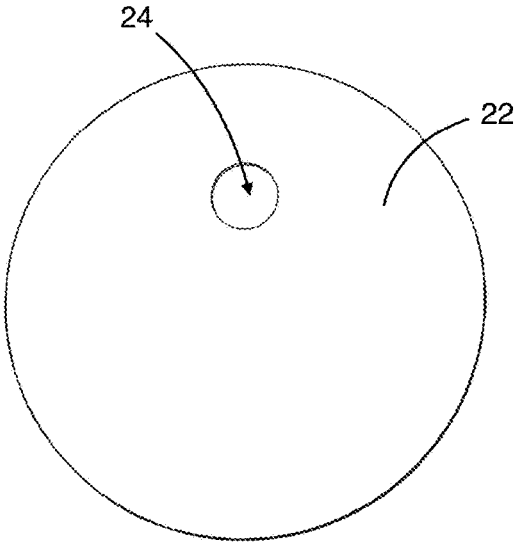
FIG. 7B is a top view of another exemplary towel according to the present disclosure.
Figure 7C:
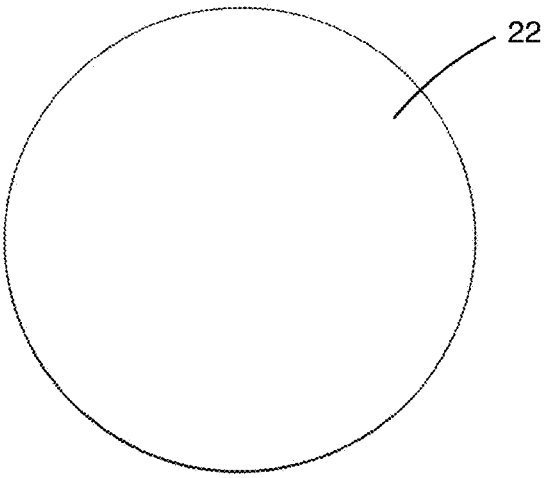
FIG. 7C is a top view of yet another exemplary towel according to the present disclosure.
Figure 7D:
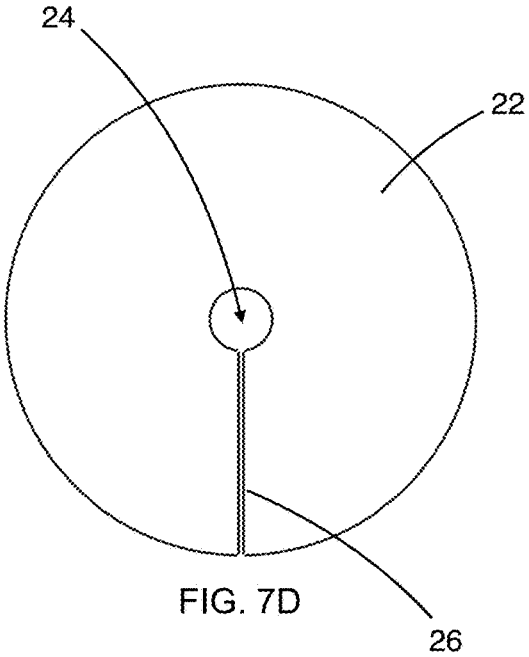
FIG. 7D is a top view of a further exemplary towel according to the present disclosure.
Figure 7E:
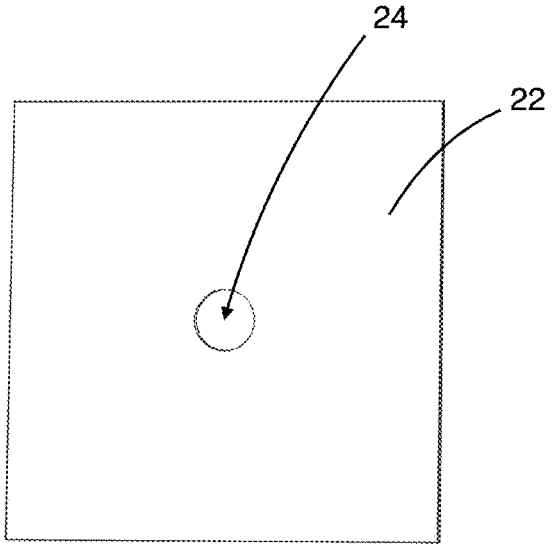
FIG. 7E is a top view of a still further exemplary towel according to the present disclosure.
Figure 7F:
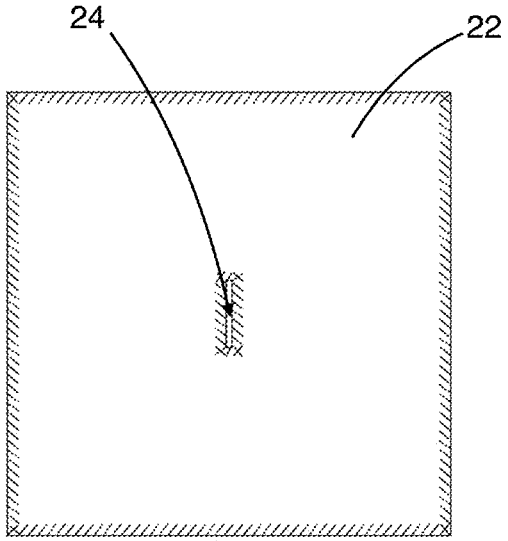
FIG. 7F is a top view of an even further exemplary towel according to the present disclosure.
Figure 7G:
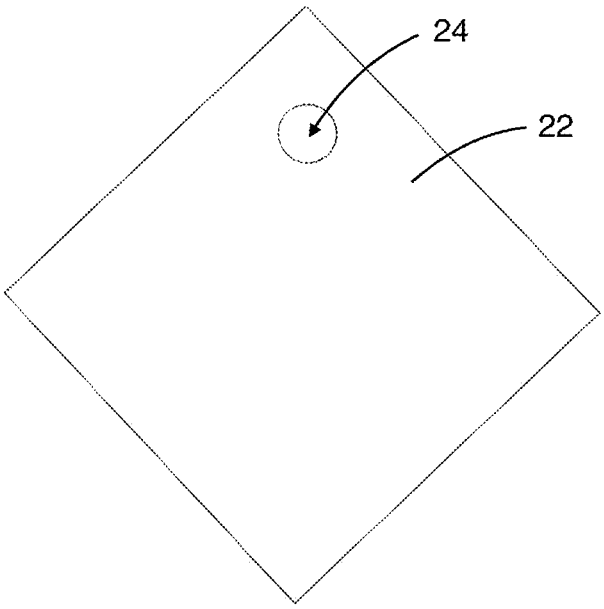
FIG. 7G is a top view of a yet further still exemplary towel according to the present disclosure.
Figure 7H:
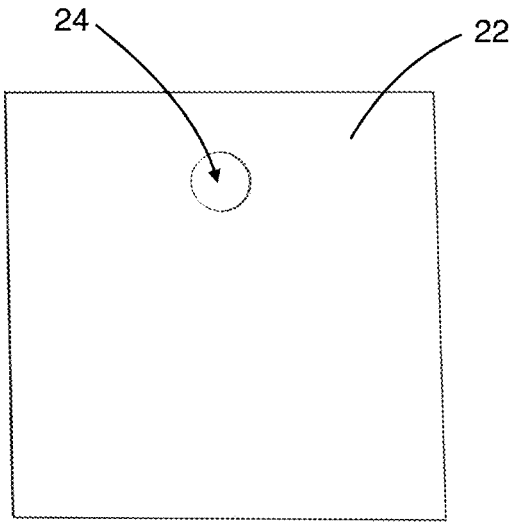
FIG. 7H is a top view of a yet other exemplary towel according to the present disclosure.
Figure 16:
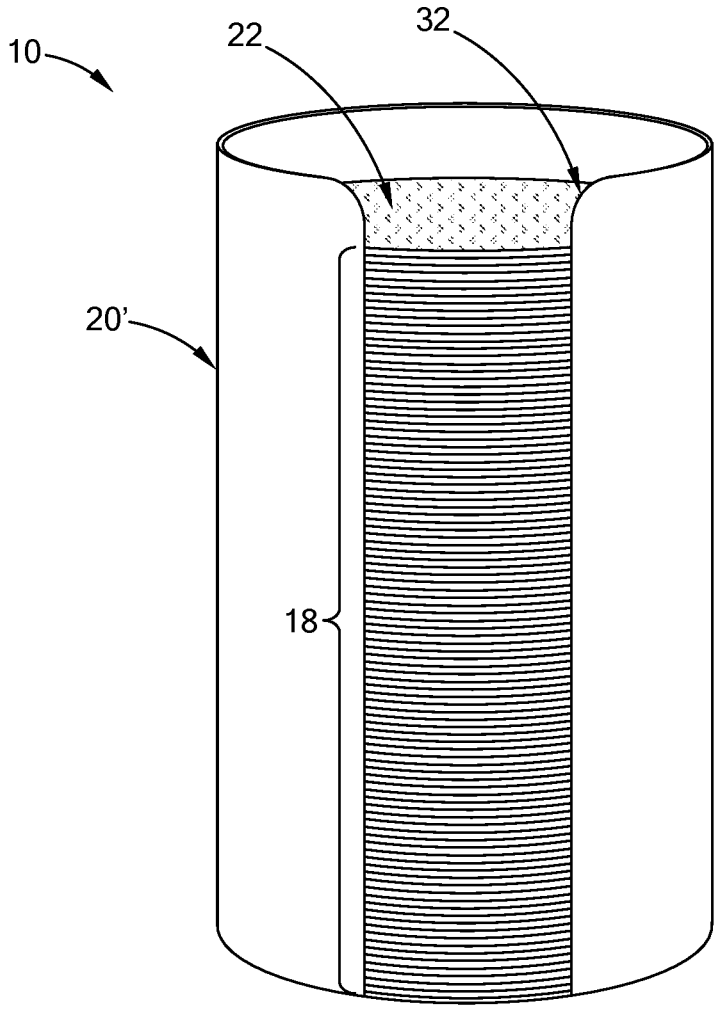
FIG. 16 is a perspective view of a towel set including a shroud according to an additional form according to the present disclosure.

Generally, each towel 22 of the plurality of towels 18 may include an opening 24. As shown in FIG. 6, the opening 24 may be in the center of the towel 22, or, as shown in other figures, such as FIGS. 7B, 7G, and 7H, the opening may be located off-center. The opening 24 may be circular, or as shown by way of not limiting example in FIGS. 7A and 7F, comprise a slit. As such, it is contemplated the opening 24 may be any desirable shape or size. The opening 24 can be reinforced via stitching, heating, gluing, applying a grommet (which can comprise, metal, rubber, cloth, nylon thread, or the like) to improve the functionality of the towel 22. The opening 24 may be threaded with a material that allows for better slidability with the elongated member 16 of the towel holder 12 such that the plurality of towels 18 are stacked on one another over the towel holder 12 and the elongated member 16 projects, or extends, through the openings 24 of the towels 22. In yet other forms, and with reference to FIG. 7D, a slot 26 extends from an outer edge of the towel 22 to the opening 24 to allow for easier stacking and dispensing of the towel 22. Further, towels 22 without any opening (such as the towel 22 illustrated in FIG. 7C) are also contemplated under the present disclosure. In such a form, it is envisioned that the towels would be stacked in a cylindrical, C-shaped holder (as shown in FIG. 16).

It is further envisioned that the plurality of towels 18 could include uniformly shaped and sized towels 22, or that some of the towels 22 could differ in geometry and/or materials from some or all of the other towels 22. The plurality of towels 18 could include towels 22 having uniform shapes and sizes. The plurality of towels 18 could include towels 22 having multiple shapes and/or sizes. The plurality of towels 18 could include towels 22 having multiple colors, multiple patterns, or the like. The plurality of towels 18 could include towels 22 all having their respective openings 24 in a uniform location. In this manner, where the elongated member 16 is in the form of a shaft, the plurality of towels 18 may be axially aligned with one another. Similarly, where the elongated member 16 is curvilinear, the plurality of towels 18 are not axially aligned with one another. The plurality of towels 18 could include towels 22 having a mixture of openings 24 in uniform locations and disparate locations. Accordingly, the towel geometries as illustrated and described herein are merely exemplary and should not be construed as limiting the scope of the present disclosure.

Figure 8A:
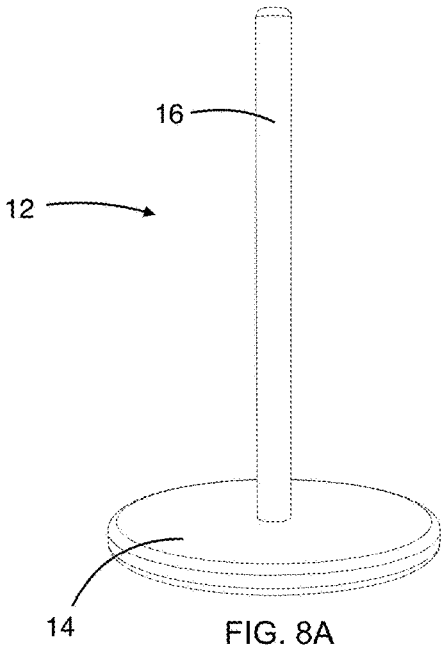
FIG. 8A is a perspective view of an exemplary towel holder according to an aspect of the present disclosure.
Figure 8B:
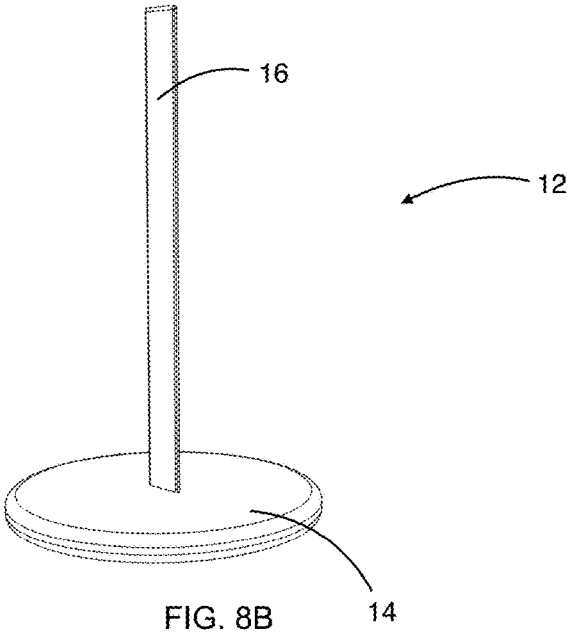
FIG. 8B is a perspective view of another exemplary towel holder according to the present disclosure.
Figure 8C:
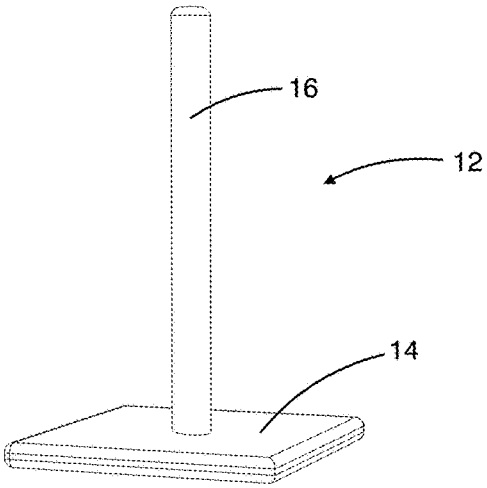
FIG. 8C is a perspective view of yet another exemplary towel holder according to the present disclosure.
Figure 8D:
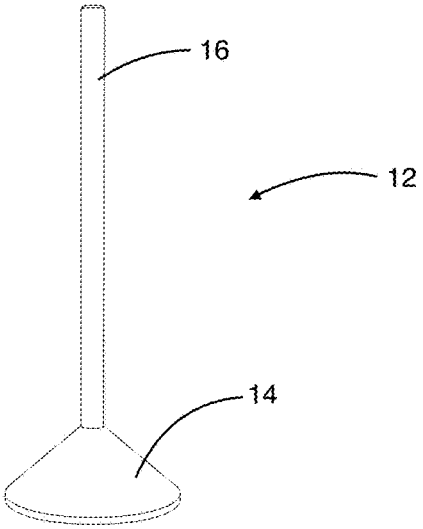
FIG. 8D is a perspective view of a further exemplary towel holder according to the present disclosure.

Turning now to FIGS. 8A-8D, the towel holder 12 including the base 14 and the elongated member 16 is further described. In a form, the base 14 may be of a similar size and shape to the towels 22, though it is also contemplated the base 14 and the towels 22 may have disparate shapes and/or sizes. The base 14 can accordingly include a round shape resembling a disk (as shown in FIGS. 8A and 8B), a rectangular or square shape (as shown in FIG. 8C), a conical shape (such as shown in 8D), or other shapes, such as pyramids, cylinders, etc. The base 14 may be decorated to blend in with the towels 22 to camouflage the base 14 from view. The elongated member 16 is in a variation the form of a shaft. It is also contemplated under the present disclosure that the elongated member 16 may be curvilinear or another non-linear shape. Like with the base 14, the elongated member 16 may be decorated to blend in with the towels 22 to camouflage the elongated member 16 from view. The shape of the elongated member 16 may be dictated by the size and/or shape of the openings 24 of the towels. For example, where the openings 24 comprise slits (such as those shown in FIGS. 7A and 7F), the elongated member 16 may be narrower (such as the elongated member 16 shown in FIG. 8B) than an elongated member 16 adapted to a circular opening (such as opening 24 shown in FIG. 7B, by way of not limiting example), circles, or the like (such as the elongated member shown in FIGS. 8A and 8C). The elongated member 16 may further be textured in another form of the present disclosure to provide a desired friction and/or slidability with respect to the removal of the towels 22 from the elongated member 16. And with respect to the openings 24 of the towels 22, the size and shape of the elongated member 16 is not limited.

The openings 24 of the towels 22 are configured to be positioned to reside along the elongated member 16. Similarly, the elongated member 16 is adapted to allow the towels 22 to slide along the elongated member 16 to allow for storage of a desired quantity of towels 22. In this manner, the towels 22 are easily removable from the elongated member 16, which is appealing in kitchen, bathroom, garage, or other setting requiring work or cleaning (e.g., nurseries, workrooms, restaurants, hotels, hospitals, for use in the cleaning industries generally, etc.) as a user can advantageously use only one hand to remove a towel (such as a towel 22) from the elongated member 16. It is contemplated that the multipurpose towels described herein can have many functions, such as by way of example, hand towels, dish towels, washcloths, napkins, make-up wipes, countertop wipes, and baby wipes, among others. By way of not limiting example, the elongated member 16 may be sized to be large enough to accept 40 double layer towels 22, 80 single layer towels 22. In another form, the elongated member 16 may be sized to accept 30 single towels. It is also contemplated that more or fewer amounts of towels could be placed along the elongated member 16. Further the elongated member 16 may comprise at least two shafts that are telescopically engaged with one another to allow for height adjustability of the elongated member 16. In yet other forms, the elongated member 16 may be adjustable in other ways, such as a gas-spring height adjustment mechanism, a rack and pinion mechanism, a cable and pulley mechanism, a ratchet mechanism, a ball screw mechanism, and removable pin and holes arrangement, among others.

Figure 9:
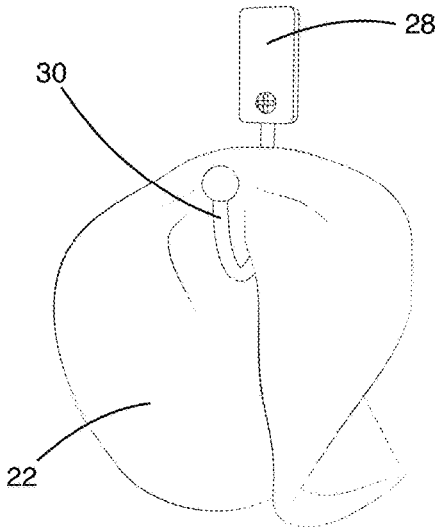
FIG. 9 is a perspective view of a hook for holding the towels according to the present disclosure.

Turning now to FIG. 9, in yet another form, when one of the towels 22 of the plurality of towels 18 are removed from the elongated member 16, the towel 22 may be used a number of times before laundering. It is contemplated that the towel 22 may, between uses, be set upon a hook 30 hung upon a fastening member 28 or the like to be reused until such time the towel 22 is no longer suitable for use and can be laundered. In a form, the hook 30 may be sized similarly to the opening 24 of the towel 22 to allow the towel 22 to hang by the opening 24 on the hook 30.

Figure 10A:
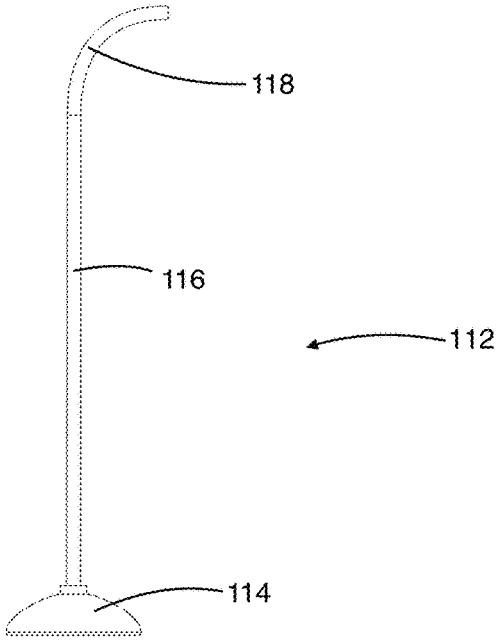
FIG. 10A is a perspective view of an additional exemplary towel holder according to an aspect of the present disclosure.
Figure 10B:
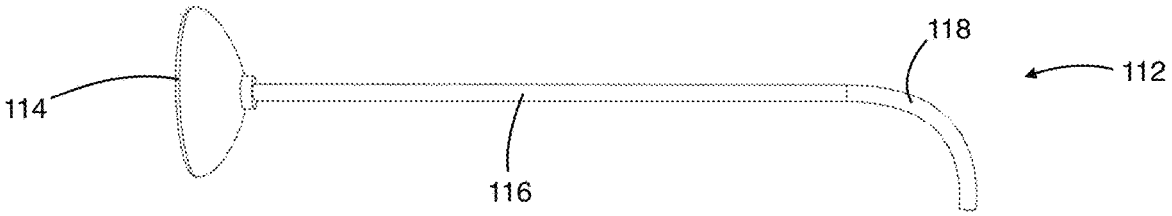
FIG. 10B is a side perspective view of the towel holder of FIG. 10A.

Referring to FIGS. 10A and 10B, in another form, the towel holder 112 can include a base 114, an elongated member 116, and an optional curved portion 118. The base 114 can comprise a fastening device, such as a suction cup, screws, glue, or the like, such that the towel holder 112 can be affixed horizontally or vertically or at an angle on a surface (such as a countertop, wall, other fixture, or the like). In yet other forms, the towel holder may not include the base 114, and the elongated member 116 could be directly affixed on a surface via a fastening device, such as a suction cup, screws, glue, or the like. Such towel holders 112 can be affixed to a wall or other fixture. In this manner, when the towel holder is affixed to the wall or other fixture horizontally, the curved portion 118 buffers the towels (such as the towels 22) from falling off the towel holder 112 when the towel holder 112 is affixed to a wall or other fixture.

Figure 11:
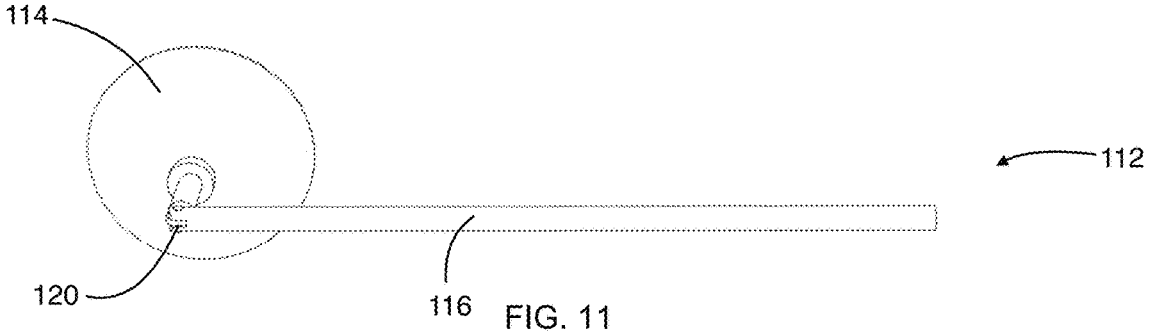
FIG. 11 is a front perspective view of an exemplary towel holder according to another aspect of the present disclosure.

Turning now to FIG. 11, it is also contemplated that the elongated member (such as the elongated member 16 or 116) further includes a hinge (or other bending/flexing mechanism) 120 such that the elongated member (such as the elongated member 16 or 116) is maneuverable, thereby allowing for repositionability in a vertical, horizontal, or other angled direction.

Figure 12:
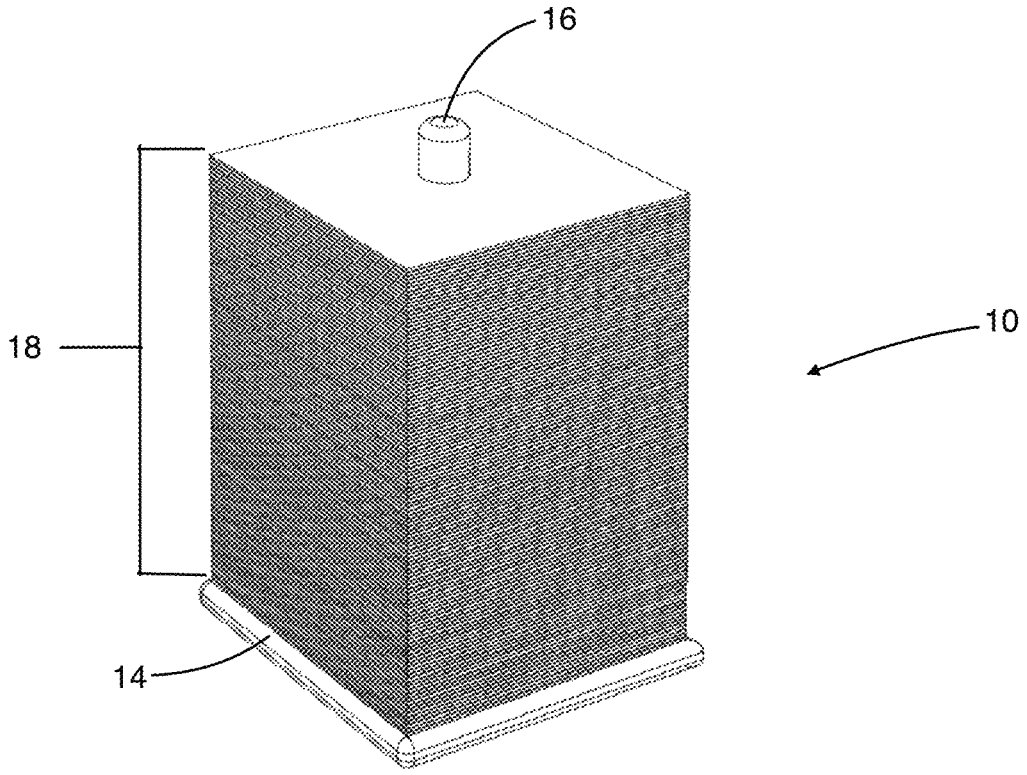
FIG. 12 is a perspective view of an exemplary towel set according to another aspect of the present disclosure.
Figure 13:
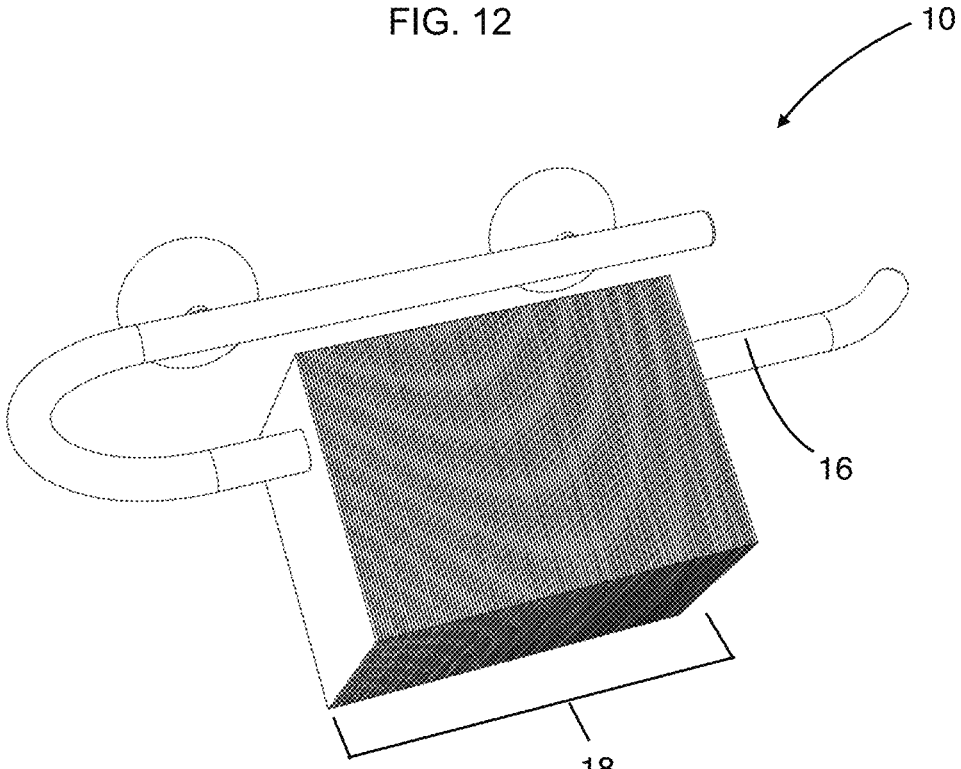
FIG. 13 is a perspective view of another exemplary towel set according to another aspect of the present disclosure.
Figure 14:
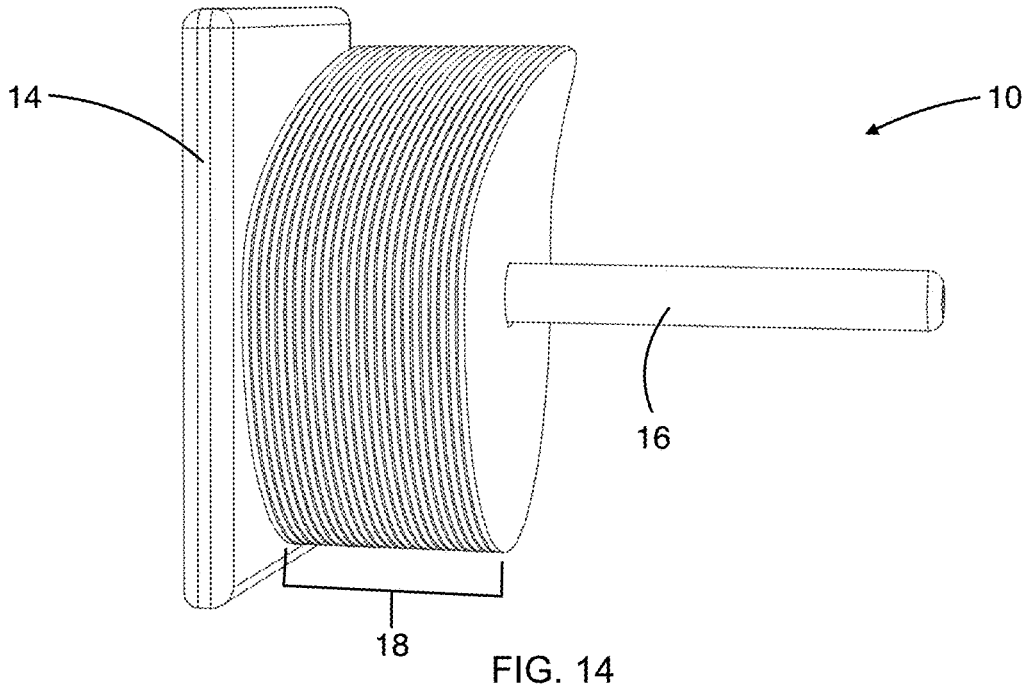
FIG. 14 is a perspective view of a further exemplary towel set according to another aspect of the present disclosure.

Turning now to FIGS. 12-14, it can be seen that where the plurality of towels (such as the plurality of towels 18) are uniform, the towel set 10 provides an aesthetically pleasing design that can be arranged vertically (as shown in FIG. 12), horizontally (as shown in FIG. 13), or the like, and that the plurality of towels can comprise any desired shape, such as squares (as shown in FIGS. 12 and 13) or circles (such as shown in FIG. 14).

Figure 15:
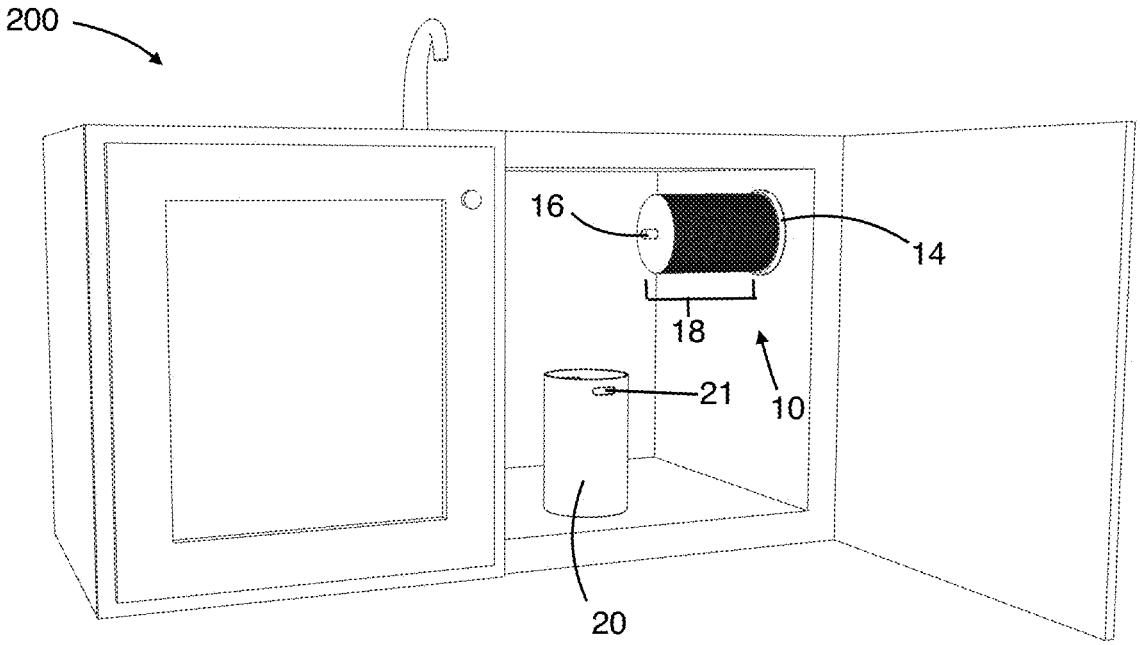
FIG. 15 is a perspective view of towel set and a shroud according to another aspect of the present disclosure installed in a cabinet fixture.

Referring to FIG. 15, the towel set 10 may be disposed within a cabinet of a fixture 200 (e.g., a kitchen cabinet fixture). The towel set 10 may be secured to the fixture 200, as shown in FIG. 15, or otherwise placed and stored within the fixture 200. Should there also be a shroud (such as the shroud 20), the shroud may be placed near the towel set 10 and be operable for holding soiled towels (such as the towels 22 describe above).

Figure 17:
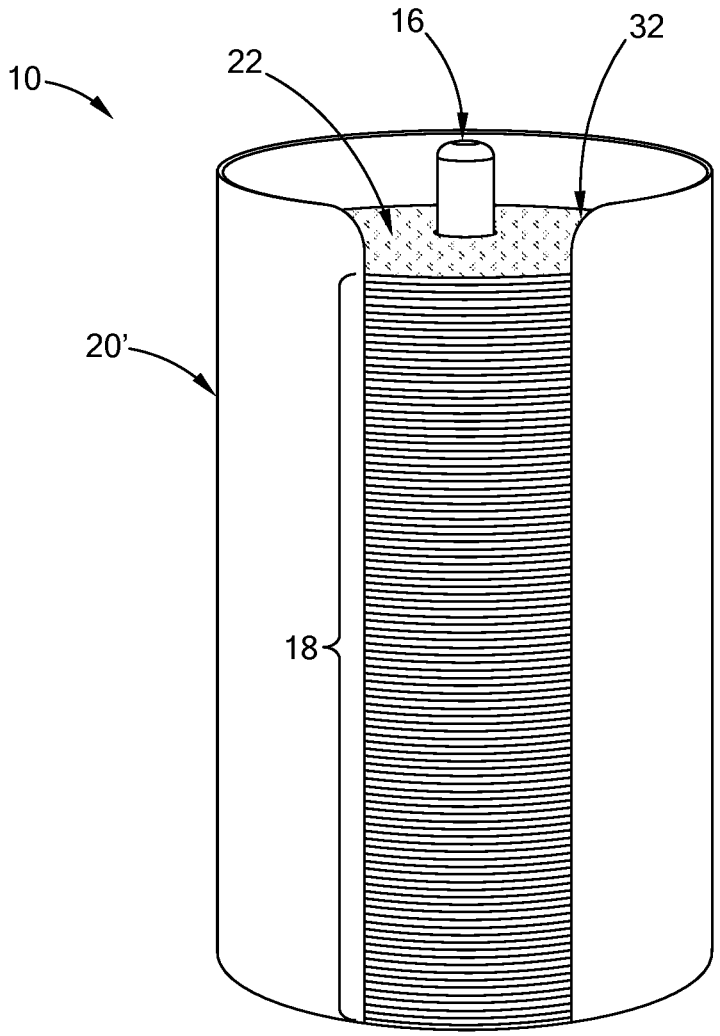
FIG. 17 is a perspective view of a towel set including a shroud according to another form according to the present disclosure.

Turning now to FIGS. 16 and 17, a variation of the shroud 20 is disclosed (referred to herein as shroud 20'). The shroud 20' includes an aperture 32. A plurality of towels 18 reside within the shroud 20'. Notably, in such a configuration, the plurality of towels 18 may comprise a stack of towels (such as a stock of individual towels 22 describe above) not having an opening referred to in 7C, as a user may reach into the aperture 32 and remove a towel 22 from the stack. As such, it is contemplated that in such a configuration, no elongated member (such as elongated member 16) would be needed. As shown in FIG. 17, however, it is also contemplated that such a configuration may include an elongated member 16.

Figure 18:
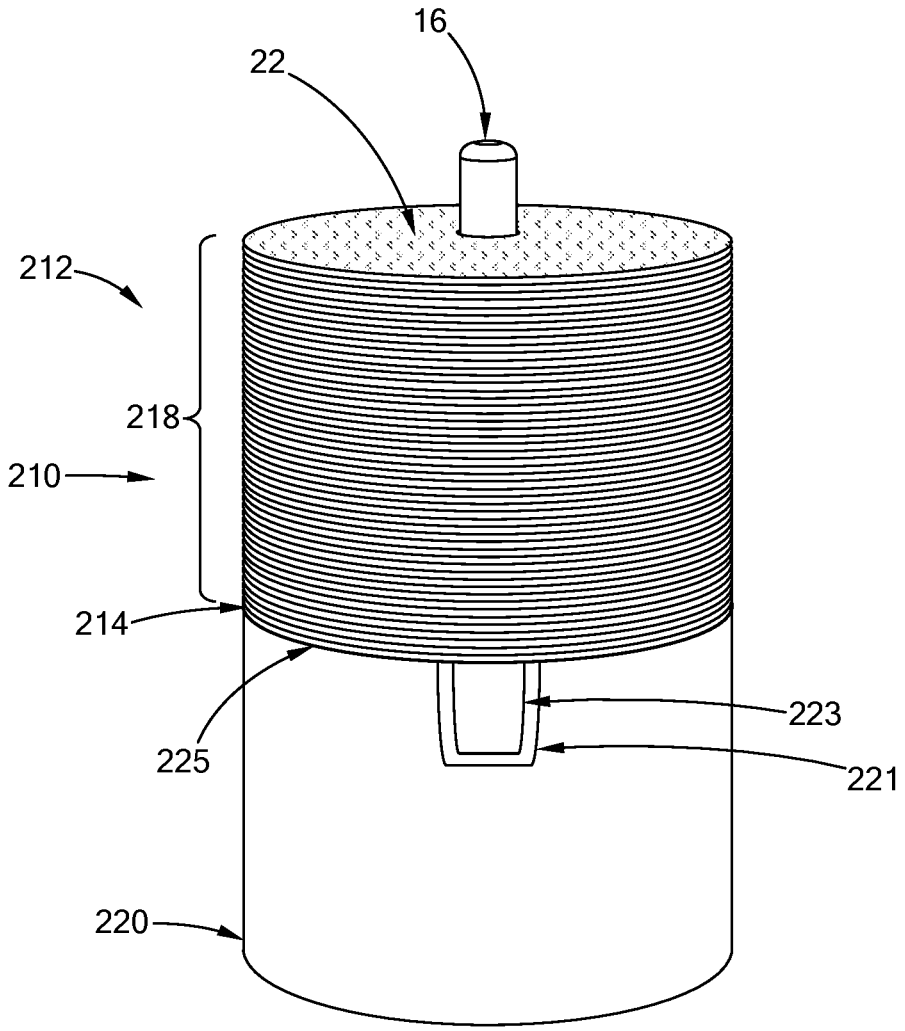
FIG. 18 is a perspective view of a towel set including a shroud according to a further form according to the present disclosure.

Turning now to FIG. 18, in another form, the present disclosure includes a towel set 210 including a towel holder 212 including a sealing member 214 (also referred to herein as a base 214) and optionally an elongated member 216. The sealing member 214 may include an elastomeric member 225 having a receiving flange (not shown) where the plurality of towels 218 rest thereon, and the sealing member 214 may have a diameter or other geometric configuration having a smaller area than the shroud 220 such that it can form a seal when positioned over the shroud 220. The towel set 210 includes a plurality of towels 218. The towel set 210 further includes a shroud 220. The shroud 220 may act as a receptacle for receiving individual members (e.g., the towel 22) of the plurality of towels 218 after use so that the plurality of towels 218 can be easily stored prior to laundering any or all of the plurality of towels 218. The shroud 220 can be placed below the sealing member 214 such that used towels may be stored and sealed away within the shroud 220. As such, it is contemplated that the base 214 and the shroud 220 can sealingly contact with one another, e.g., by having similar shapes, by having sealing members, or the like. The shroud 220 optionally further includes a cutout 221. The cutout 221 optionally may comprise a door 223 in hinged connection with the shroud 220. In this manner, used towels may be deposited in the shroud 220 after use without removing the sealing member 214 from the shroud 220. The shroud 220 may also act as a cover for packaging and/or covering the towel holder 212 and the plurality of towels 218.

The description of the disclosure is merely exemplary in nature and, thus, variations that do not depart from the substance of the disclosure are intended to be within the scope of the disclosure. Such variations are not to be regarded as a departure from the spirit and scope of the disclosure. Furthermore, various omissions, substitutions, combinations, and changes in the forms of the systems, apparatuses, and methods described herein may be made without departing from the spirit and scope of the disclosure even if said omissions, substitutions, combinations, and changes are not explicitly described or illustrated in the figures of the disclosure.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information, but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A towel set comprising:

a towel holder comprising an elongated member; and a plurality of individual and separated towels stacked on one another in a direction along the elongated member, wherein each towel comprises an opening, each opening being reinforced, wherein the elongated member projects through the openings of the towels and the towels are stacked in the same direction as the elongated member of the towel holder.

2. The towel set according to claim 1, wherein the plurality of towels comprise a plurality of double-layered towels.

3. The towel set according to claim 1, wherein the plurality of towels comprise a plurality of single-layered towels.

4. The towel set according to claim 1, further including a shroud extending around at least a portion of the plurality of stacked towels.

5. The towel set according to claim 1, wherein the towel holder is hinged.

6. The towel set according to claim 1, wherein the towel holder is height adjustable.

7. The towel set according to claim 1, wherein the towel holder comprises a suctioning device.

8. A towel set comprising:

a plurality of individual and separated stacked towels, wherein each towel comprises an opening, each opening being reinforced, the openings are configured to receive an elongated member, and wherein the towels are stacked in the same direction as the elongated member.

9. The towel set according to claim 8 further, wherein the openings are axially aligned.

10. The towel set according to claim 8, wherein the openings define a geometry selected from the group consisting of round, slit, and buttonhole.

11. The towel set according to claim 10, wherein the openings are located at a central portion of the towel.

12. The towel set according to claim 10, wherein the openings are located at a position off-center of the central portion.

13. The towel set according to claim 8, wherein the towels define a geometry selected from the group consisting of round, square, and polygonal.

14. The towel set according to claim 8, further including a shroud extending around at least a portion of the plurality of stacked towels.

15. The towel set according to claim 8 further comprising a towel holder, the towel holder comprising a base and the elongated member secured to the base, wherein the plurality of stacked towels rest on the base.

16. The towel set according to claim 8, further including a shroud in sealing contact with a base for retaining used towels.

17. A towel set comprising:

a towel holder comprising a base and an elongated member secured to the base; and a plurality of individual and separated towels stacked on one another, each towel comprising an opening, each opening being reinforced, wherein the elongated member projects through the openings of the towels and the towels are stacked in the same direction as the elongated member of the towel holder.

18. The towel set according to claim 17, further including a shroud extending around at least a portion of the towel set.

19. The towel set according to claim 17, wherein the elongated member is curvilinear.

20. The towel set according to claim 17, wherein a width of the elongated member is adapted to the openings of the towels.

* * * * *